US007303405B2

(12) United States Patent
Ikeda et al.

(10) Patent No.: US 7,303,405 B2
(45) Date of Patent: Dec. 4, 2007

(54) JUNCTION BLOCK CIRCUIT STRUCTURE HAVING A NEGATIVE ELECTRODE CONNECTOR AND A POSITIVE ELECTRODE CONNECTOR

(75) Inventors: Tomohiro Ikeda, Shizuoka (JP); Yasutaka Miyazaki, Shizuoka (JP); Shigeki Matsumoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 406 days.

(21) Appl. No.: 10/969,970

(22) Filed: Oct. 22, 2004

(65) Prior Publication Data

US 2005/0090154 A1 Apr. 28, 2005

(30) Foreign Application Priority Data

Oct. 24, 2003 (JP) ..... 2003-364515

(51) Int. Cl.
*H01R 12/00* (2006.01)

(52) U.S. Cl. ..... 439/76.2

(58) Field of Classification Search ..... 439/65, 439/650, 210, 211, 76.1, 76.2
See application file for complete search history.

(56) References Cited

U.S. PATENT DOCUMENTS 2,899,668 A * 8/1959 Gribben ..... 439/115
4,909,744 A * 3/1990 Muto ..... 439/65
5,425,659 A * 6/1995 Banks ..... 439/650
6,488,540 B2 * 12/2002 Coyle et al. ..... 439/650

* cited by examiner

*Primary Examiner*—Chandrika Prasad
(74) *Attorney, Agent, or Firm*—Kratz, Quintos & Hanson, LLP

(57) ABSTRACT

Positive electrode busbar 1 and 13 and negative electrode busbar 6 and 10 to 12 are provided. A plurality of positive electrode terminals 2*a*, 3*a* and 13*a* following to positive electrode busbar are disposed in one connector housing to constitute connectors 21 and 26, and a plurality of negative electrode terminals 8*a*, 9*a* and 10*a* to 12*a* following to negative electrode busbar are disposed in the other connector housing to constitute the connectors 24 and 25 of negative electrode and they are applied to the junction block circuit structure A. The positive electrode busbar 1 and 13 and negative electrode busbar 6 and 10 to 12 are disposed in different layer intervening an insulating plate. Each positive electrode busbar 1 and negative electrode busbar 6 is connected to the total output part of battery circuit, the total output part 1*a* and 6*a* of inverter circuit and other output parts, the other output parts are provided with positive terminals 2*a* and 3*a* and negative terminals 8*a* and 9*a*. The total output part 1*a* and 6*a* are disposed in the center of the junction block. The invention makes connector miniaturize and simple.

5 Claims, 6 Drawing Sheets

JUNCTION BLOCK CIRCUIT STRUCTURE HAVING A NEGATIVE ELECTRODE CONNECTOR AND A POSITIVE ELECTRODE CONNECTOR

BACKGROUND OF THE INVENTION

1. Field of the Invention

This invention relates to a junction block circuit structure in which a connector is formed by collecting separately positive and negative electrode terminals.

2. Related Art

A junction block, which is connected between a battery and an inverter of an electric vehicle (including a hybrid car), conventionally adopts a circuit structure as shown in FIG. 6.

The junction block circuit structure has a constitution described as follows. A first circuit 101 is connected to the circuit (not shown) following a positive electrode of a battery (not shown) and is through a fuse 116 of a high current and a relay 118 of a positive power supply and is connected to the circuit (not shown) of a positive electrode of an inverter side by a first output part 101*a* of a positive electrode.

A second circuit 102 branches from the first circuit 101 between the relay 118 and the first output part 101*a*, and follows to a second output part 102*a* of a positive electrode in a first connector 121 through a fuse 120 for a low current.

A third circuit 103 branches from the first circuit 101 between the relay 118 and the first output part 101*a*, and follows through a fuse 120 to a third output part 103*a* of a positive electrode in a second connector 122.

A fourth circuit 104 branches from the first circuit 101 between the fuse 116 for high current and the relay 118, and has a fourth output part 104*a* of a positive electrode to a terminal.

A fifth circuit 105 branches from the first circuit 101 between the relay 118 and the first output part 101*a*, and has a fifth output part 105*a* of a positive electrode to a terminal.

A sixth circuit 106 is connected to the circuit (not shown) following a negative electrode of the battery (not shown) and is through an electric sensor 129 and a relay 119 of negative power supply and is connected to the circuit (not shown) of a negative electrode of the inverter side by a sixth output part 106*a* of a negative electrode.

A seventh circuit 107 branches from the sixth circuit 106 between the relay 119 and the sixth output part 106*a*, and follows to the seventh output part 107*a* of a negative electrode in the first connector 121.

A eighth circuit 108 branches from the sixth circuit 106 between the relay 119 and the sixth output part 106*a*, and follows to the eighth output part 108*a* of a negative electrode in the second connector 122.

A ninth circuit 109 branches from the sixth circuit 106 between the relay 119 and the sixth output part 106*a*, and has the ninth output part 109*a* of a negative electrode to a terminal.

The first and second connector 121 and 122 include a connector housing provided in the junction block main body made of synthetic resin, and the output parts 102*a*, 107*a*, 103*a*, and 108*a* received in the connector housing (including protrusions positioned in the connector housing). Moreover, an inverter (not shown) is for replacing the direct-current electric power of the battery with alternating-current power, and sending the alternating-current power to a three-phase current motor of vehicles.

The conventional junction block circuit structure receives the positive electrode and the negative electrode in one connector. Since the difference of voltage between both terminals is large, insulation between both terminals is fully performed within the connector resulting to cause a large size and high cost of the connector.

Moreover, the circuits of the positive electrode and the negative electrode are arranged intersecting in the junction box and become complicated. Then, the insulation between the circuit of the positive electrode and the circuit of the negative electrode is fully carried out and causes a large size and high cost of the junction block itself as well as the large size of the connector.

SUMMARY OF THE INVENTION

The present invention provides a junction block circuit structure with a compact and low cost junction block which solves a large size and a complication of a connector originating from circuits and terminals of positive and negative electrodes.

In order to attain the object of the inventuin, the junction block circuit structure is provided with a positive electrode busbar and negative electrode busbar. A plurality of positive electrode terminals following to the positive electrode busbar is disposed in one connector housing, and a plurality of negative electrode terminals following to the negative electrode busbar is disposed in an other connector housing.

Thereby, a plurality of same electrode terminals are arranged in the connector housing made of insulated resin. Since the difference of voltage among each terminal is zero or very small, the insulation between each terminal is not required so that the connector is miniaturized.

Preferably, the positive electrode busbar and the negative electrode busbar are arranged in different layers separating in an insulating plate.

Thereby, the positive electrode busbar and the negative electrode busbar are not crossed in the same plane so as to be arranged with high insulation. The positive electrode busbar and/or the negative electrode busbar are arranged together closely and with high density. Moreover, for example the negative electrode busbar may be arranged over or closely with the positive electrode busbar, and the positive electrode busbar and the negative electrode busbar are disposed adjacently in parallel and the positive electrode connector and the negative electrode connector are arranged adjacently in parallel. The positive electrode busbar and the negative electrode busbar may be separated largely and the positive electrode terminal and the negative electrode terminal may be arranged with a large separation and the positive electrode connector and the negative electrode connector may be arranged with a large separation. Then, it is able suitably to arrange each electrode connector with a desired location.

Preferably, each of the positive electrode busbar and the negative electrode busbar follows to a total output part of a battery circuit, a total output part of an inverter circuit, and other output parts which are provided with the positive electrode and negative electrode terminals.

Thereby, a battery side circuit of electric vehicles is connected with an inverter side circuit through a busbar and other output parts of each electrode busbar is connected to the circuit of an auxiliary device other than the inverter where the terminals in each connector is the same electrode and the connector is miniaturized and a connector of an opponent circuit is also miniaturized.

Preferably, the total output part is disposed at the center of the junction block and the positive electrode terminal and the negative electrode terminal are arranged on both sides of the total output part.

Thereby, the inverter side circuit is connected to the total output part in the central location with better workability and each electrode connector is efficiently connected to the other output parts of both sides from the same direction as the connecting direction of the inverter side circuit. The positive electrode terminal and negative electrode terminal are disposed distantly separated and the insulation between connectors of both electrodes is assured.

Preferably, the positive electrode terminal and negative electrode terminal are connected to the converter circuit of 100V AC.

Thereby, besides the inverter for a motor drive of vehicles, the connectors are connected to the converter circuit of 100V AC for home electronics with the same electrode without a voltage difference and an energization to the converter circuit of 100V AC is assuredly made without short-circuiting.

DETAILED DESCRIPTION OF THE PREFERRED EMBODIMENTS

Figure 1:
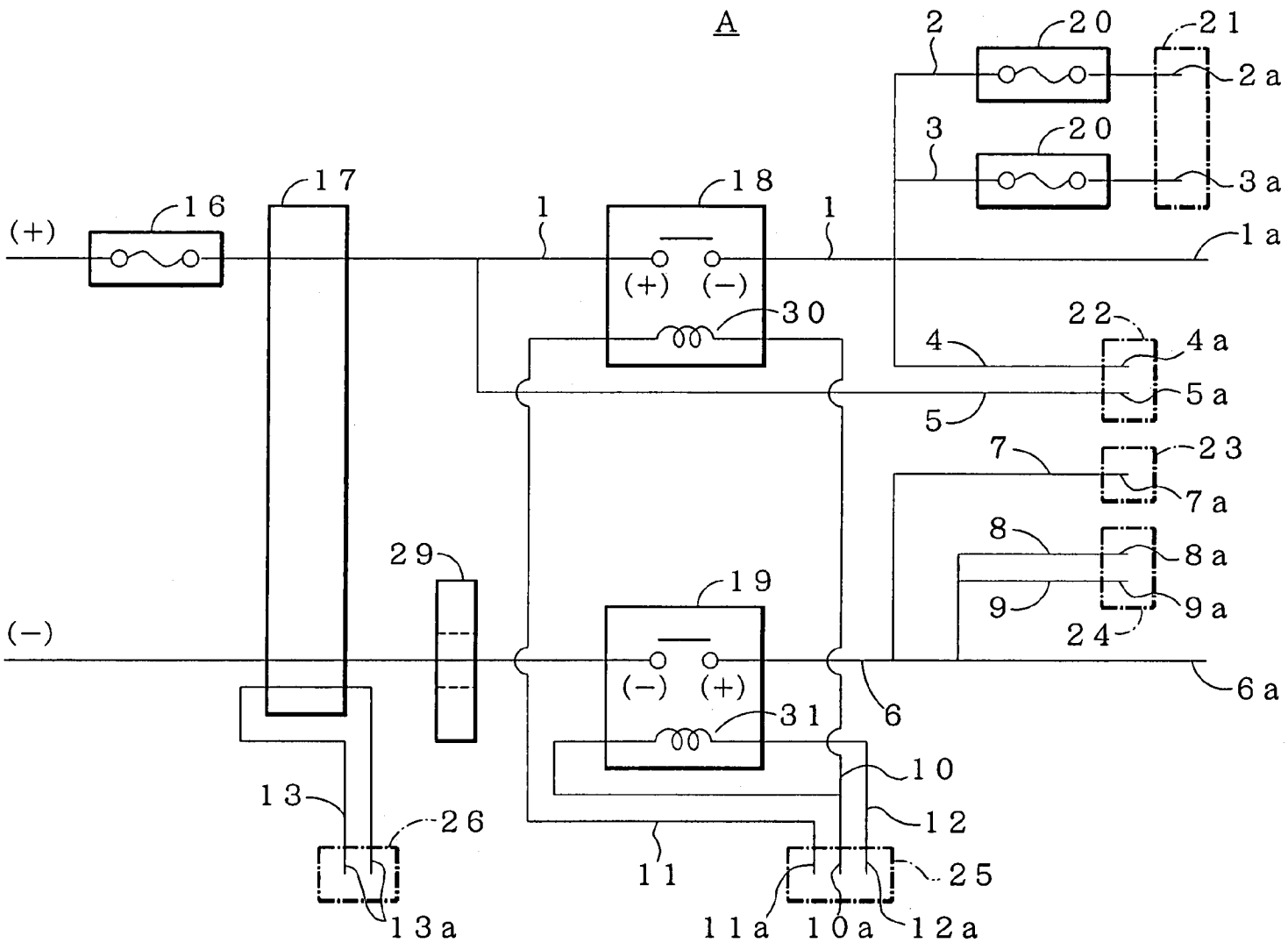
FIG. 1 is a schematic diagram of a circuit showing an embodiment of a junction block circuit structure according to the present invention.

FIG. 1 is a schematic diagram showing an embodiment of a junction block circuit structure according to the present invention.

In FIG. 1, a junction block circuit structure A has the following constitution.

A first circuit 1 having a first output part (total output part) 1*a* of a positive electrode is connected to a circuit (not shown) following from the positive electrode of a battery (power supply) and is through a fuse 16 for large current, a service plug 17, and a relay 18 of positive power supply, one by one, and is connected to a circuit (not shown) of a positive electrode of an inverter side of an electric vehicle (including hybrid car) (not shown).

A second circuit 2 branches from the first circuit 1 between the relay 18 and the first output part 1*a*, and follows through a fuse 20 for low current to a second output part 2*a* of positive electrode in a first connector 21 for a circuit (not shown) of a positive electrode of 100V AC conversion.

A third circuit 3 branches in the middle of the second circuit 2, and follows to the third output part 3*a* of a positive electrode in the first connector 21 through a fuse 20 for low current.

A fourth circuit 4 having a fourth output part 4*a* of a positive electrode in a second connector 22, branches from the first circuit 1 between the relay 18 and the first output part 1*a*, and for example is connected to a circuit of a DC/DC converter (not shown) side.

A fifth circuit 5 branches from the first circuit 1 between the service plug 17 and the relay 18, and has a fifth output part 5*a* of positive electrode in the second connector 22.

A sixth circuit 6 having the sixth output part (total output part) 6*a* of the negative electrode is connected to the circuit (not shown) following from the negative electrode of the battery (power supply) and is through the service plug 17, a current sensor 29 and a relay 19 of negative power supply, one by one, and is connected to the circuit (not shown) of the negative electrode of the inverter side.

A seventh circuit 7 having the seventh output part 7*a* of a negative electrode in a third connector 23, branches from the sixth circuit 6 between the negative power supply relay 19 and the sixth output part 6*a*, and for example is connected to the circuit of the DC/DC converter (not shown) side.

A eighth circuit 8 branches from the sixth circuit 6 between the relay 19 of a negative power supply and the sixth output part 6*a*, and follows to the eighth output part 8*a* of a negative electrode in the fourth connector 24 for the circuit (not shown) of a negative electrode of 100V AC conversion.

A ninth circuit 9 branches from the eighth circuit 8 and follows to the ninth output part 9*a* of negative electrode in the fourth connector 24.

A tenth circuit 10 of negative electrode having a tenth output part 10*a* for a relay drive (excitation side) in a fifth connector 25, follows to one side of a coil 30 in the relay 18 of the positive power supply.

A eleventh circuit 11 having an eleventh output part 11*a* of a negative electrode in the fifth connector 25, follows to another side of the coil 30.

A twelfth circuit 12 has a twelfth output part 12*a* of negative electrode in the fifth connector 25 following from the one side of a coil 31 in the relay 19 of the negative power supply, in common, and the tenth output part 10*a* following from the other side of the coil 31.

A thirteenth circuit 13 has a thirteenth output part 13*a* of a positive electrode of both ends to detect the intermittence of the service plug 17 in a sixth connector 26 and is connected to the service plug 17 and is a short-circuit for detecting the service plug 17.

Each output part 1*a* and 6*a* of the first and the sixth circuit 1 and 6 is connected to the total output of the inverter circuit side by means such as screw. The second and the third connector 22 and 23 are also possible to replace with connection means, such as a screw bundle terminal.

When a worker intermits the inverter side circuit to the junction block circuit structure A for maintenance, the service plug 17 intercepts the circuit in the junction block to avoid electric shock. The thirteenth circuit 13 for detecting the service plug 17 is to certify that the service plug 17 is intercepted or not.

The inverter transforms direct-current electric power of the battery into alternating current electric power for vehicles motors, and 100V AC conversion circuit follows to the converter which changes the direct-current electric power of the battery for home-use (for campers) electric appliances apart from the inverter.

As shown in FIG. 1, the second and third output parts 2*a* and 3*a* which are the output parts of same potential (no potential difference) of two positive electrodes are disposed in the first connector 21. The fourth and fifth output parts 4*a* and 5*a* which are the output parts of two positive electrodes disposed in the second connector 22. The eighth and ninth output parts 8*a* and 9*a* which are the output parts of same potential (no potential difference) of two negative electrodes are disposed in the fourth connector 24. The tenth and twelfth output parts 10*a* to 12*a* which are the output part of three negative electrodes are disposed in the fifth connector 25, and the thirteenth output part 13*a* which is the output part of same potential (no potential difference) of two negative electrodes is disposed in the sixth connector 26.

Thereby, the insulating constitution among each terminal in the connectors 21 to 26 is not necessary and the connectors 21 to 26 are miniaturized and then the junction block A can also be miniaturized. Especially, the first connector 21 and the fourth connector 24 show remarkably the effect.

Each connector 21 to 26 are included in a connector housing made of at least synthetic resin and terminals are received in the connector housing. The connector is classified into a connector having a connector fitting chamber to protrude a plurality of male terminals and a connector having terminal receiving chamber to receive each female terminal. The above effect is especially prominent to the former connector (connector having a fitting chamber) which does not have insulating wall between terminals. The latter connector is also effective as the terminal receiving chamber is formed thinner.

Each the first to fifth circuit 1 to 5 of the positive electrode is arranged in order and each the sixth to ninth circuit 6 to 9 of the negative electrode is also arranged in order and the positive first to fifth electrode circuit 1 to 5 and the negative electrodes sixth to ninth circuit 6 to 9 are not crossed to arrange separately. The circuit structure becomes simple resulting in the miniaturization of the junction block A and its low cost due to shortening of the circuit length and ease of circuit arrangement.

Figure 2:
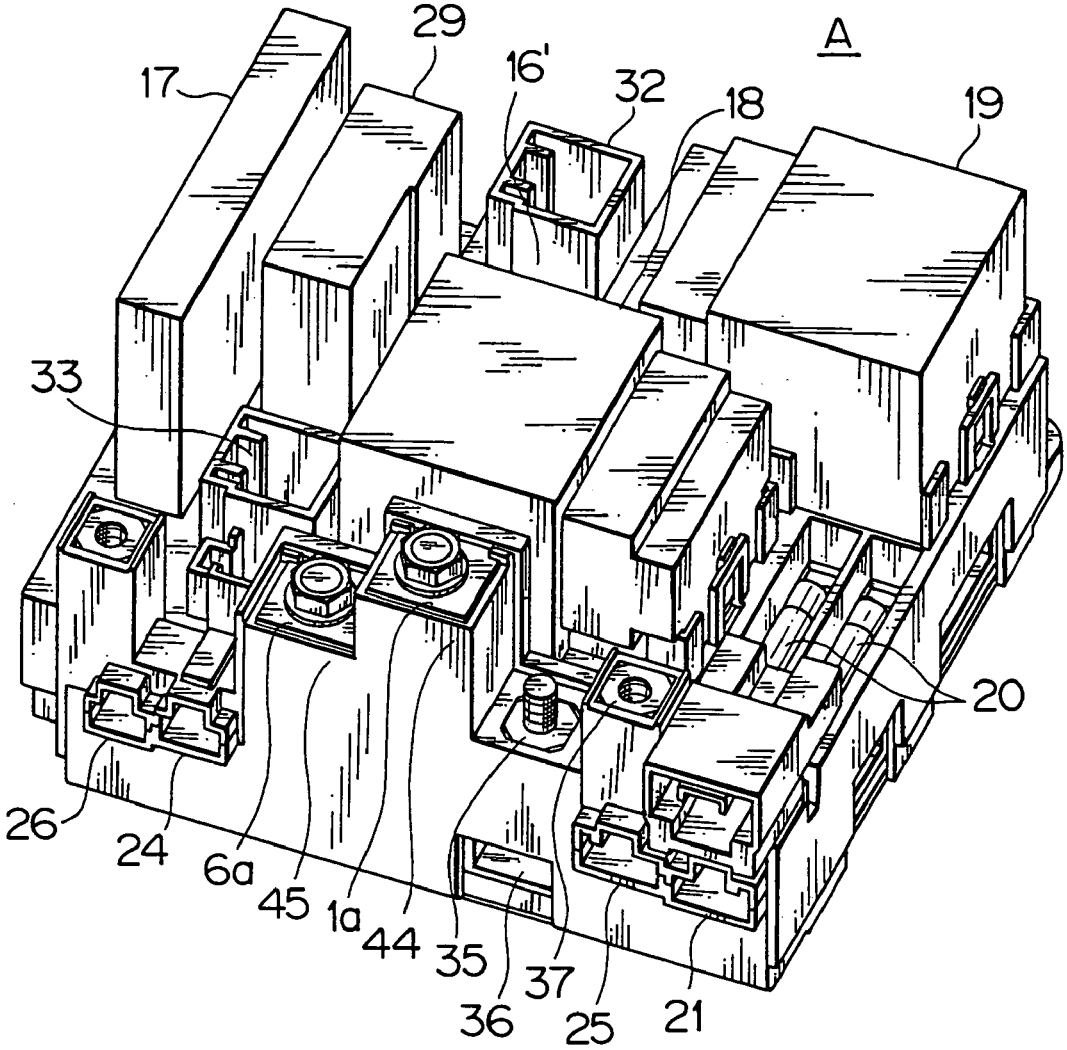
FIG. 2 is a perspective view of an embodiment of the junction block A.
Figure 3:
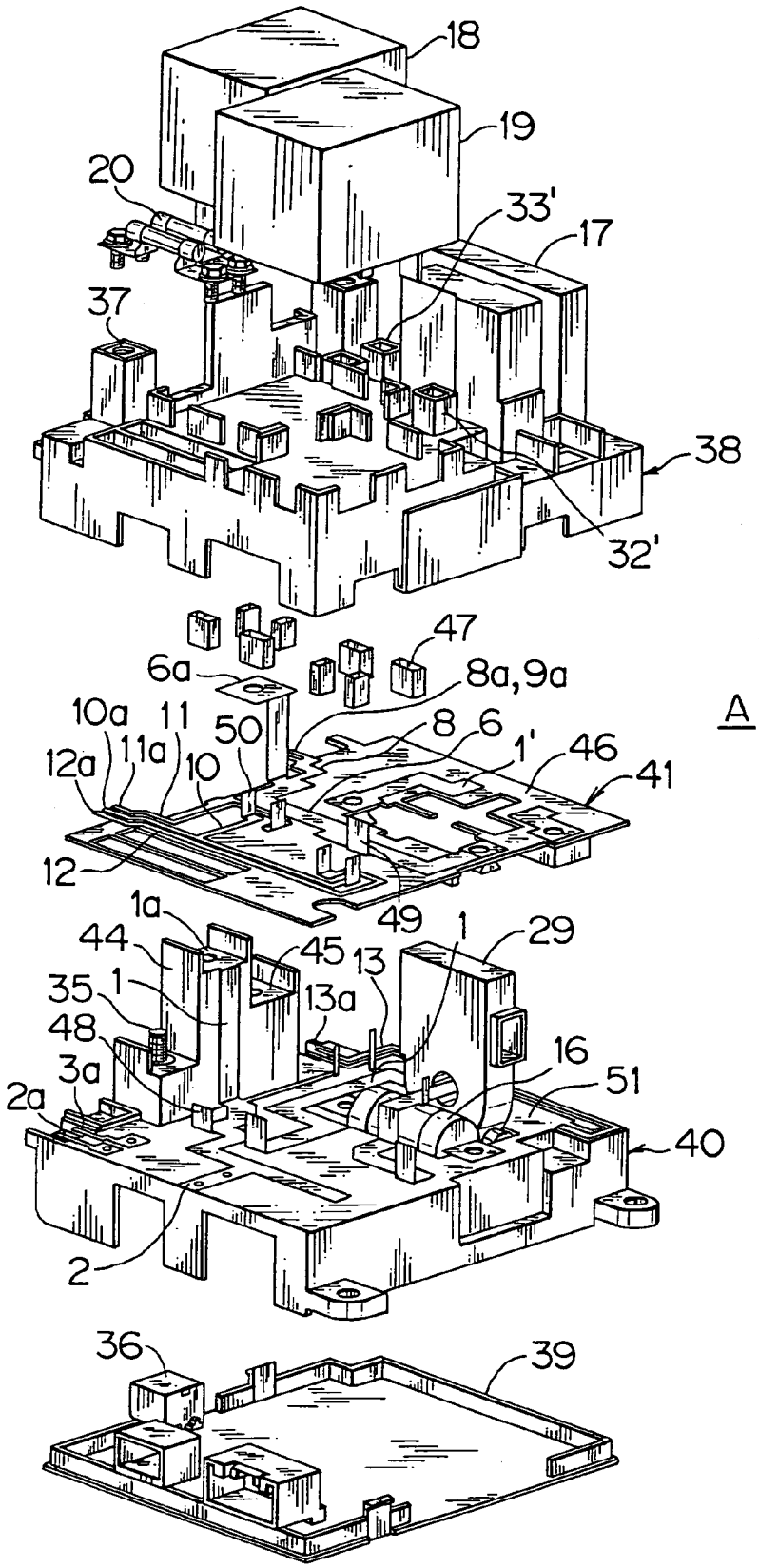
FIG. 3 is an exploded perspective view of the junction block A.
Figure 4:
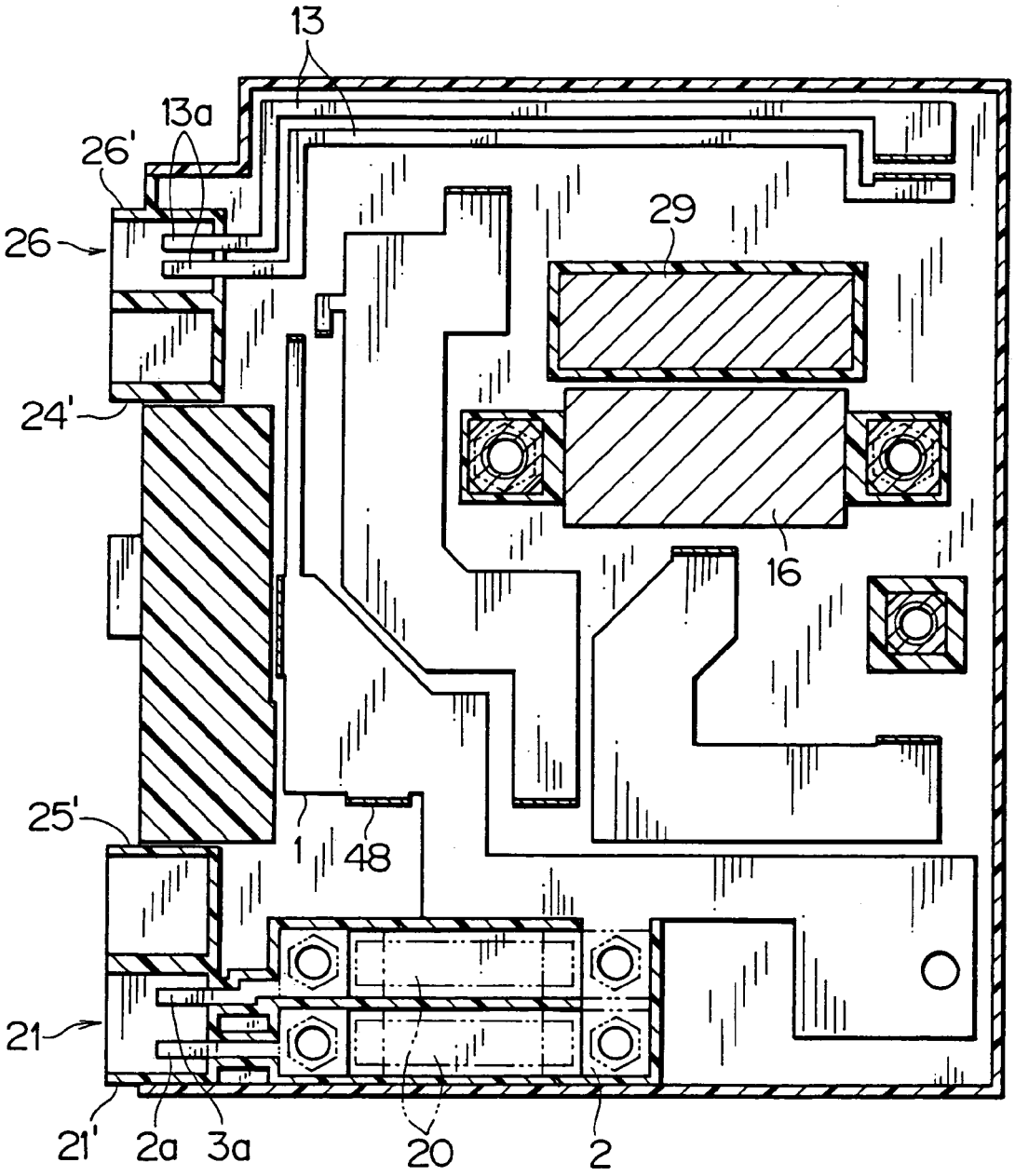
FIG. 4 is a plan view showing a middle cover of a positive circuit side of the junction block A.

FIGS. 2 to 4 are diagrams showing an embodiment of the junction block A adopted to the above circuit structure. The same numerals as used in FIG. 1 are given to corresponding parts and therefore, their detailed explanation is omitted.

Numeral 32 is the connector of the total input side (total input part) following to the positive electrode of a battery, numeral 33 the connector of the total input side (total input side) following to the negative electrode of the battery, numeral 16' a receiving portion of the large current fuse 16, numeral 17 the service plug, numeral 18 the relay of the positive electric power supply, numeral 19 the relay of the negative electric power supply, numeral 20 two fuses for small current and numeral 29 current sensor.

Numeral 44 is a terminal base of positive electrode of the total output having the output part 1*a* connecting the circuit of positive electrode of the inverter side, numeral 45 a terminal base of negative electrode of the total output having the output part 6*a* connecting the circuit of negative electrode of the inverter side, numeral 21 the first connector receiving a plurality of positive electrode terminals 2*a* and 3*a* (FIG. 1) and connected to the circuit of positive electrode of 100V AC conversion, numeral 24 the fourth connector receiving a plurality of negative electrode terminals 8*a* and 9*a* (FIG. 1) and connected to the circuit of negative electrode of 100V AC conversion, numeral 25 the fourth connector connecting to the circuit of the relay drive (exciting side), numeral 26 the sixth connector connecting to the interlock circuit for detecting service plug.

Numeral 35 is the terminal base to connect the DC/DC side circuit, numeral 36 the connector to connect the vehicle side circuit and numeral 37 the terminal base to connect to ground. The terminal base is for connecting the terminals of the junction block to the opponent terminals (not shown) by bolt, nut or a like.

As shown in FIG. 3, the junction block A is provided with an upper cover 38 made of synthetic resin, a lower cover 39, a middle cover 40, a middle plate 41 disposed over the middle cover 40, and a shield case (not shown) made of conductive metal disposed below the middle cover 40.

The upper cover 38 is provided with the service plug 17, the positive electrode relay 18, the negative electrode relay 19, a connector housing 32' of the positive electrode for the battery total input, and a connector housing 33' of the negative electrode. The lower cover 39 is provided with a connector 36 connecting to the vehicle.

As shown in FIGS. 3 and 4, the middle cover 40 has the positive electrode busbars 1, 2 and 13 arranged on a horizontal insulating wall 51 and is provided with the current sensor 29, the high current fuse 16, the low current fuse 20, and the terminal base 35 which connects the terminal base 44 of the positive electrode of the inverter total output with the negative electrode terminal base 45 and, the terminal base 35, or a like which a connects DC/DC converter of 12V (not shown).

Figure 5:
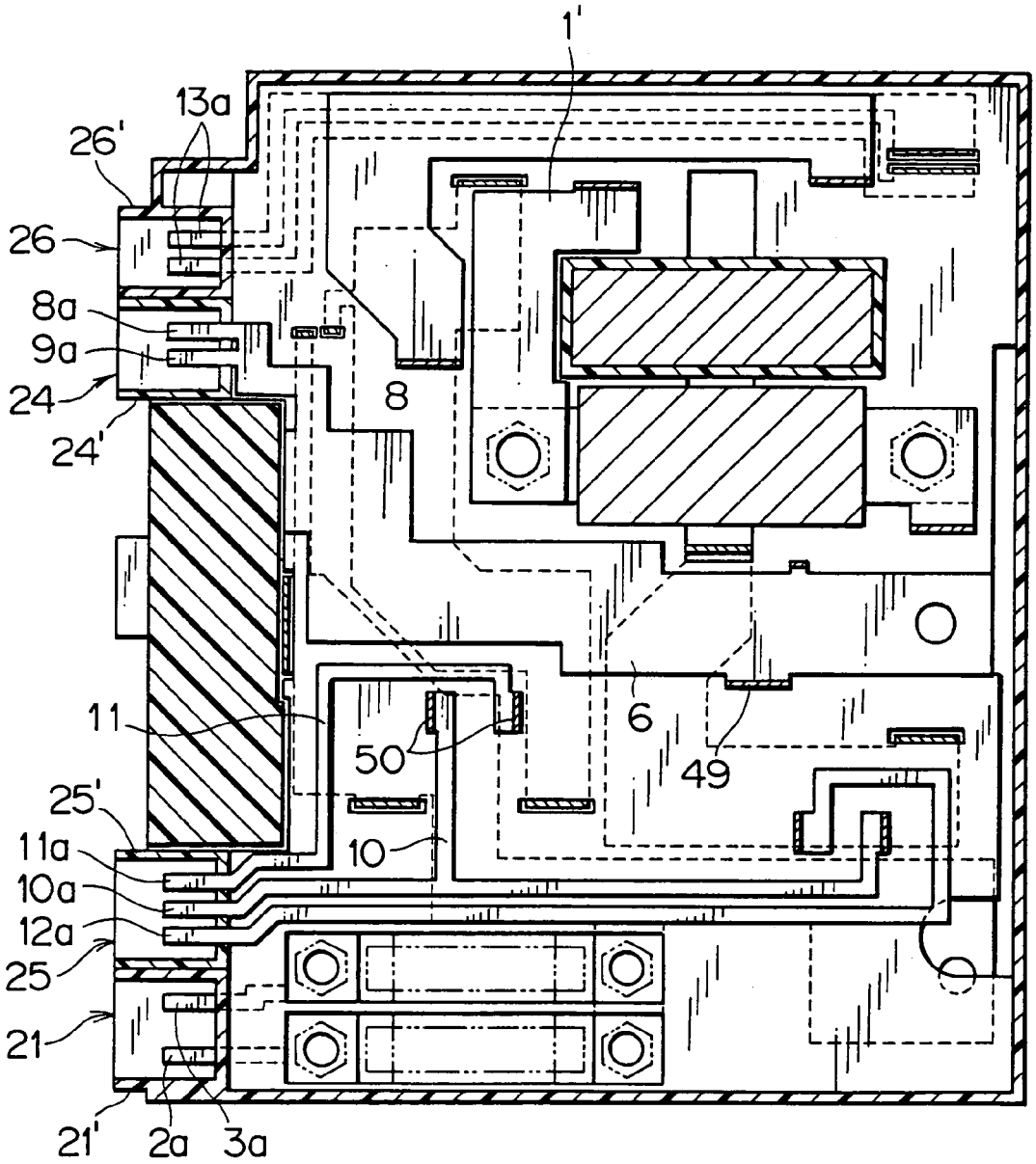
FIG. 5 is a plan view showing a middle plate of a negative circuit of the junction block A.
Figure 6:
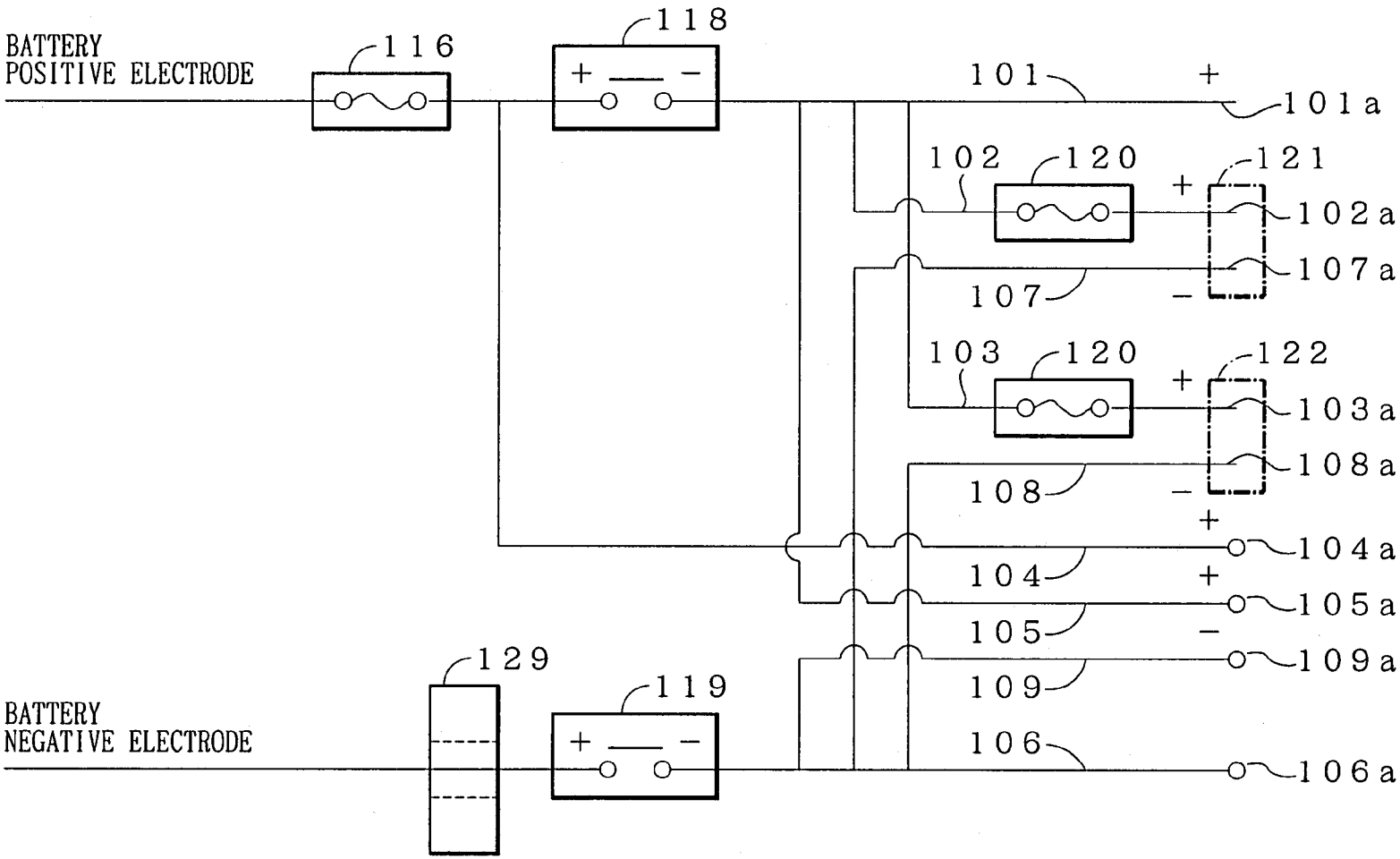
PRIOR ART FIG. 6
FIG. 6 is a schematic diagram of a circuit showing a conventional junction block.

As shown in FIGS. 3 and 5, the middle plate 41 is provided with the busbars 6, 8 and 10 to 12 of mainly negative electrode on an insulating plate 46, a busbar 1' of a part of positive electrodes, and a plurality of female-female shave for connecting relay which connects each terminal 48 to 50 of the negative electrode busbar 6 and the positive electrode busbar 1 of the middle cover 40. The positive busbar 1' connects high current fuse 16 of the middle cover 40 and the service plug 17.

The fuse 16 for high current is connected with the power supply of the battery side from the terminal in the connector 33 of the upper cover 38 through a busbar (not shown). The terminals in the connector 33 are started up with the busbar. Current from the service plug 17 is connected to the relay 18 of positive power supply through the terminal 48 of the positive electrode busbar 1 of the middle cover 40 side and is connected to each of the second and third terminal 2*a* and 3*a* of the flat positive electrode for 100V AC conversion circuit through the relay 18, the positive electrode busbar 1 of the middle cover 40 side and the two fuses 20 for low current of the negative electrode side. Since the terminals 2*a* and 3*a* are same polarity electrode, they are received in the connector housing 21' of the side of the upper cover 38 and constitutes a small connector 21 (FIG. 4). The connector housing 21' may or may not be integrated with the upper cover 38.

The terminal 13*a* of two horizontal positive electrodes for interlock, which follows from the positive electrode busbar 13, is arranged in parallel on the other side of the middle cover 40.

An up-stand portion (6*a*) of the negative electrode busbar 6 on the middle plate 41 is connected to the terminal base 45 of the negative electrode for inverter connection of the middle cover 40 and the two terminals 8*a* and 9*a* of negative electrode for 100V AC conversion circuit are provided ajut horizontally on the negative electrode busbar 6. Since both 8*a* and 9*a* are the same polarity electrode, they are received in a connector housing 24' in the side of the upper cover 38 and form a small connector 24 (FIG. 5).

Terminals 49 and 50 of the negative electrode busbar 6 and 10 to 12 on the middle plate 41 are connected to the negative power supply relay 19 of the upper cover 38 and three terminals 10*a* to 12*a* of the negative electrode for the relay drive are provided ajut horizontally on the negative electrode busbar 10 to 12. Since each terminal of 10*a* to 12*a* is the same polarity electrode, they are received in the connector housing 25' in the side of the upper cover 38 and form a small connector 24 (FIG. 5).

Each terminal base 44 and 45 of the positive and negative electrode of the input part for the inverter is disposed in the center of the junction block A and is divided into connecting to the positive electrode busbar 1 and 13 on the middle cover 40 and the busbar 6 and 10 to 12 of negative electrode on the middle plate 41, from the center.

The positive electrode busbar 1 and 13 and busbar 6 and 10 to 12 of negative electrode are separated in upper and lower layer intervening the insulating plate 46 of the middle plate 41 so that the insulation between busbars of both electrodes is assuredly made, the busbar 1, 13, 6, 10 to 12 of same electrode in each layer is closely and densely arranged, terminals 2*a*, 3*a*, 13*a*, 8*a*, 9*a*, 10*a* to 12*a* of the same electrode are easily gathered in a desired position, and small connectors of same electrode are formed.

The above embodiment shows the example of using the service plug 17. The junction block A or its circuit can be formed without using the service plug 17, and the connectors of 21 and 24 to 26 of same electrode and the simplification of the circuit can still be attained.

The above embodiment shows the example of connecting the junction block A to the battery and inverter, however, it is not limited to the example of an application of the junction block A and it is applicable to all kinds of junction blocks having an input and output side of an electric power supply.

The above embodiment shows that the positive electrode busbar 1 and 13 are disposed in the middle cover 40 and the busbar 6 and 10 to 12 of negative electrode are disposed in the middle plate 41. On the contrary, the negative electrode busbar may be disposed in the middle cover 40 and the positive electrode busbar may be disposed in the middle plate 41.

The above embodiment shows the example of utilization of the upper cover 38, the middle cover 40 and the lower cover 39. However, for example removing the middle cover 40, the positive or negative electrode busbar may be disposed in the lower cover 39 (different from the form of FIG. 3). The positive electrode busbar may be disposed on another insulating plate (not shown) instead of the middle cover 40.

What is claimed is:

1. A junction block circuit structure, comprising:

a positive electrode busbar and a negative electrode busbar;

a plurality of positive terminals following to the positive electrode busbar being disposed in a connector housing to form a positive electrode connector; and a plurality of negative terminals following to the negative electrode busbar being disposed in an other connector housing to form a negative electrode connector.

2. The junction block circuit structure according to claim 1, wherein the positive electrode busbar and the negative electrode busbar are arranged in different layers intervening an insulating plate.

3. The junction block circuit structure according to claim 1, wherein each of the positive electrode busbar and the negative electrode busbar is connected to a total input part of a battery circuit, a total output part of an inverter circuit and other output parts which are provided with the positive electrode terminal and the negative electrode terminal.

4. The junction block circuit structure according to claim 3, wherein the total output part is disposed in the center of the junction block and the positive electrode terminal and the negative electrode terminal are disposed at both sides of the total output part.

5. The junction block circuit structure according to claim 3, wherein the positive electrode terminal and the negative electrode terminal are connected to a 100V alternating-current conversion circuit.

* * * * *